US012404753B2

(12) United States Patent
Hinkley et al.

(10) Patent No.: US 12,404,753 B2
(45) Date of Patent: Sep. 2, 2025

(54) ADJUSTING FLUID INJECTION INTO A WELLBORE BASED ON RELATIVE PERMEABILITY OF A FORMATION

(71) Applicant: Landmark Graphics Corporation, Houston, TX (US)

(72) Inventors: Richard Hinkley, Houston, TX (US); Erdinc Eker, Houston, TX (US)

(73) Assignee: Landmark Graphics Corporation, Houston, TX (US)

( * ) Notice: Subject to any disclaimer, the term of this patent is extended or adjusted under 35 U.S.C. 154(b) by 294 days.

(21) Appl. No.: 18/148,852

(22) Filed: Dec. 30, 2022

(65) Prior Publication Data

US 2024/0218769 A1 Jul. 4, 2024

(51) Int. Cl.
*E21B 43/16* (2006.01)
*E21B 49/08* (2006.01)

(52) U.S. Cl.
CPC ..... *E21B 43/164* (2013.01); *E21B 49/0875* (2020.05)

(58) Field of Classification Search
CPC ..... E21B 43/164; E21B 49/0875
See application file for complete search history.

(56) References Cited

U.S. PATENT DOCUMENTS 5,027,898 A * 7/1991 Naae ..... E21B 43/24 166/305.1
5,528,030 A * 6/1996 Mickael ..... G01V 5/107 250/269.4
2002/0173915 A1* 11/2002 Egermann ..... G01N 15/08 702/12
2008/0154563 A1* 6/2008 Kumar ..... E21B 43/00 703/10
2015/0142407 A1* 5/2015 Wakefield ..... G01V 1/28 703/10
2015/0346010 A1 12/2015 Matringe et al.
2016/0177686 A1 6/2016 Carvajal et al.
(Continued)

FOREIGN PATENT DOCUMENTS

CN 111814347 * 10/2020 ..... E21B 47/00
WO 2007076044 A2 7/2007

OTHER PUBLICATIONS

Land, "Calculation of Imbibition Relative Permeability for Two- and Three-Phase Flow From Rock Properties", SPE Journal 8, Jun. 1968, pp. 149-156.

(Continued)

*Primary Examiner* — Lisa M Caputo
*Assistant Examiner* — Sharah Zaab
(74) *Attorney, Agent, or Firm* — Kilpatrick Townsend & Stockton LLP

(57) ABSTRACT

A fluid injection process for injecting fluid into a wellbore can be adjusted based on relative permeability. An actual trapped gas saturation of a formation can be determined from a maximum gas saturation, a maximum trapped gas saturation, and an actual gas saturation. A pseudo-maximum gas saturation can be determined from the actual trapped gas saturation, the maximum trapped gas saturation, and actual gas saturation. A relative permeability of the formation can be determined by mapping the pseudo-maximum gas saturation along a drainage curve. The fluid injection process can be adjusted based on the relative permeability.

20 Claims, 5 Drawing Sheets

(56) References Cited

U.S. PATENT DOCUMENTS

| | | | | |
|---|---|---|---|---|
| 2020/0202060 | A1* | 6/2020 | Thakur | E21B 43/16 |
| 2021/0381363 | A1 | 12/2021 | Hadibeik et al. | |

OTHER PUBLICATIONS

Larsen et al., "Methodology for Numerical Simulation With Cycle-Dependent Relative Permeabilities", SPE Journal Jun. 1998, pp. 163-173.

International Patent Application No. PCT/US2022/082654, International Search Report and Written Opinion mailed Sep. 20, 2023, 8 pages.

* cited by examiner

ADJUSTING FLUID INJECTION INTO A WELLBORE BASED ON RELATIVE PERMEABILITY OF A FORMATION

TECHNICAL FIELD

The present disclosure relates generally to hydrocarbon recovery operations and, more particularly (although not necessarily exclusively), to fluid-injection operations for a wellbore.

BACKGROUND

Water-alternating-gas injection may be a technique employed to extract hydrocarbons from a subsurface formation that may not otherwise be extractable. The technique may involve alternatively injecting a water-based solution and carbon dioxide into a wellbore to displace hydrocarbons more effectively within a subsurface formation. The state of matter, or phase, of fluids injected into the wellbore can change unpredictably. These phase changes can affect the recoverability of hydrocarbons in the formation.

DETAILED DESCRIPTION

Figure 1:
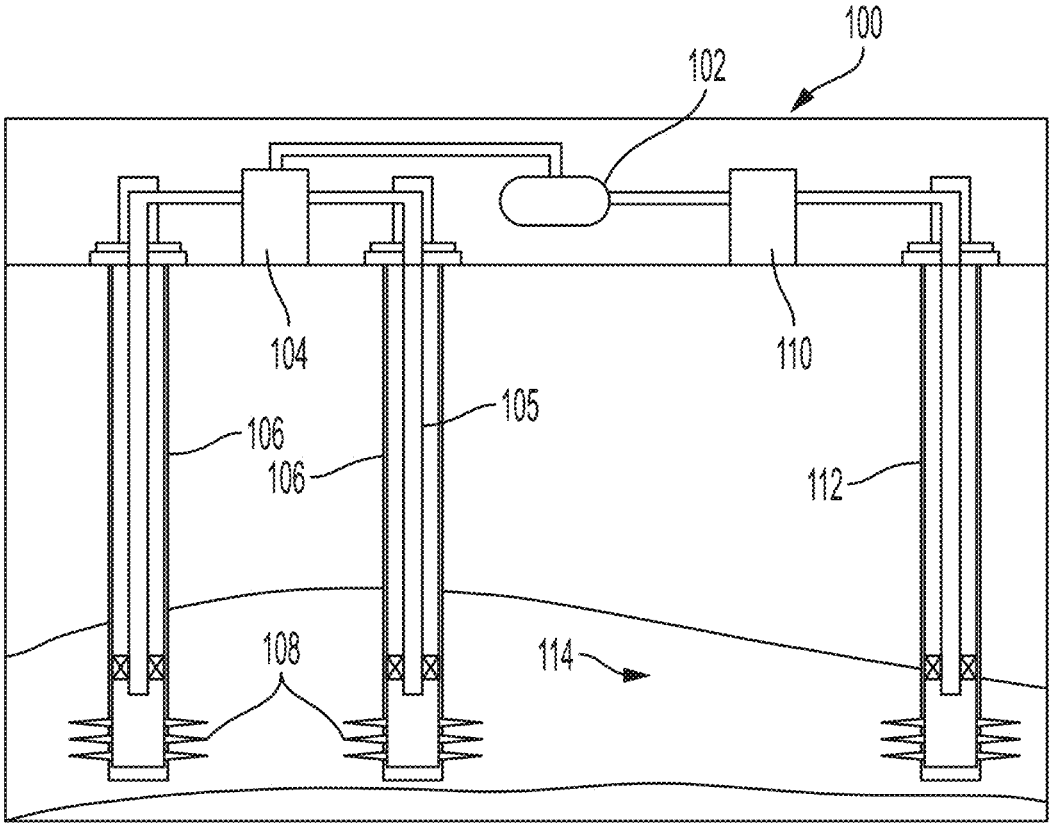
FIG. 1 is a schematic of a production and fluid injection system for a subsurface formation according to some aspects of the present disclosure.

Certain aspects and examples of the present disclosure relate to adjusting fluid injection into a wellbore based on a relative permeability of a subsurface formation. Relative permeability can be a ratio of the effective permeability of a particular fluid at a particular saturation against the absolute permeability of the same fluid at total saturation. Effective permeability of a subsurface formation can be a measure of the ability of that particular fluid to flow in the presence of other fluid phases. Saturation may be the relative amount of water, carbon dioxide, and hydrocarbon in the pores of the subsurface formation.

The relative permeability of a subsurface formation can provide an estimate of total hydrocarbon reserves within the subsurface formation. As a result, relative permeability can be used to inform decisions about rates of hydrocarbon production from the subsurface formation. Hydrocarbon production from the subsurface formation, in turn, can be regulated by adjusting fluid injection into a wellbore of the subsurface formation.

Data for relative permeability to a fluid can be determined based on gas saturation data. But, it may be challenging to determine relative permeability data when the value for gas saturation data falls below the value for trapped gas saturation data. Trapped gas saturation data may be a saturation data value at which a fluid mixture from a water-alternating-gas hydrocarbon recovery process may have no movement within pores of a subsurface formation unless gas saturation is increased.

In some examples of the present disclosure, a relative permeability of a subsurface formation can be determined with a given water and carbon-dioxide based fluid mixture and with a given gas saturation data value, regardless of the gas saturation data value being above or below the trapped gas saturation data value. By determining a relative permeability with a gas saturation data value regardless of the value's quantity relative to a trapped gas saturation data value, the total hydrocarbon reserves of a subsurface formation can be estimated with a wider range of data. With more computationally accessible estimates of total hydrocarbon reserves in a subsurface formation, water-alternating-gas operations can be more effectively controlled so that hydrocarbon production can align with a demand for the hydrocarbons or capacity for hydrocarbon extraction.

Also, determining a relative permeability, regardless of a saturation value relative to a trapped gas saturation data value, can more accurately estimate a capacity of a depleted subsurface formation for the purpose of a carbon dioxide geological sequestration process. The relative permeability of the depleted subsurface formation may determine a storage rate of carbon dioxide or inform the design of a surface facility for sequestering carbon dioxide. Also, condensation effects resulting from phase changes to the sequestered carbon dioxide may be estimated by the actual trapped gas saturation data. Removing carbon dioxide from the atmosphere and sequestering the carbon dioxide in depleted subsurface formations can mitigate or defer effects of global warming, which may help avoid dangerous weather events that may be caused by climate change.

In addition to determining relative permeability regardless of a saturation value relative to a trapped gas saturation data value, the relative permeability can be determined at a maximum gas saturation data value without requiring the model effects of interfacial tension. Interfacial tension may be an accumulation of energy and an imbalance of force at an interface of two distinct phases of material, such as a liquid phase and a gaseous phase. By avoiding consideration of interfacial tension, time and resources may be saved my avoiding tests that may be necessary to determine interfacial tension.

Water-alternating-gas production simulations can depend on modeling relative permeability. Subsurface formations in which fluids are near or have reached a supercritical phase may be particularly dependent on modeling. During an actual water-alternating-gas production scenario, trapped gas saturation data may be obtained at the wetting phase. At this point, simulated gas may have no mobility within the subsurface formation unless simulated gas saturation is increased. It may be less clear how to model cases where gas saturation data value drops below the trapped gas saturation data threshold due to phase behavior and then increases due to displacement from fluid injection.

In some examples of a water-alternating-gas production simulation, the simulation may begin with the fluid mixture in a gaseous phase. This may cause a large, implied trapped gas saturation data value. The simulation may proceed to a point where the fluid mixture injected into the formation and hydrocarbons within the formation become a single phase, supercritical oil. Alternatively, the simulation may proceed to a point where the fluid mixture injected into the formation and the hydrocarbons within the formation become subcritical. For the case of the supercritical oil, previously disclosed simulations that may not be able to account for gas saturation data value below a trapped gas saturation data value and may report an unlikely predicted outcome in which some or all of the simulated trapped gas saturation disappears.

In some examples of a water-alternating-gas simulation where relative permeability can be reliably determined regardless of gas saturation data being above or below the trapped gas saturation data, fluid injection can be adjusted with a wider set of simulation inputs. As a result, fluid injection can be better controlled with regard to either the amount of fluid injected into a wellbore, or the composition of the fluid injected into the wellbore. Additionally or alternatively, phases of fluid injection can be better controlled. For example, relative permeability can help determine the volume and duration of a wetting phase, in which a low-salinity water-based solution is injected into the wellbore and a non-wetting phase, in which a carbon-dioxide gas is injected into the wellbore. In some examples, the relative permeability, as an indication of a subsurface formation's total reserves of hydrocarbons, can inform the design of a surface facility intended for extracting the hydrocarbons.

Illustrative examples are given to introduce the reader to the general subject matter discussed herein and are not intended to limit the scope of the disclosed concepts. The following sections describe various additional features and examples with reference to the drawings in which like numerals indicate like elements, and directional descriptions are used to describe the illustrative aspects, but, like the illustrative aspects, should not be used to limit the present disclosure.

FIG. 1 is a schematic of a production and fluid injection system 100 for a subsurface formation 114 according to some aspects of the present disclosure. The production wells 106 may allow fluids from the subsurface formation 114 to flow through their completion 108 and to the surface, where production tubing 105 may carry the fluids to production gathering facilities 104, and in turn, to a separator 102. The separator 102 system may isolate each fluid phase (typically oil, gas, and water). In some cases, the water or gas produced are separated and then sent to an injection distribution system 110. The injection distribution system 110 can also receive injection fluids from exterior sources. The injection wells 112 may receive the fluids to be injected from the injection distribution system 110 via a network of pipelines and inject these fluids in the subsurface formation 114 through well completions 108.

In some embodiments, the reservoir fluid mixtures may be composed of two or more phases including oil, water, or gas. The subsurface formation 114 itself may be composed of multiple different wells or well blocks. These well blocks may have different physical properties. For example, the well blocks may have formed in different manners geologically. The wells may include different amounts of oil, gas, water, or other materials. Still further, the well blocks may be subject to different pressures owing to the varied materials amounts, or other forces such as the injection of fluids in adjacent or neighboring wells. Moreover, each well in the subsurface formation 114 may have stronger or weaker connections to other wells in the reservoir. Accordingly, in such cases a computer system may be used to model physical material flow relationships between wells in the subsurface formation 114, including connections between the injection well 112 and production wells 106 as well as between wells and aquifers.

Figure 2:
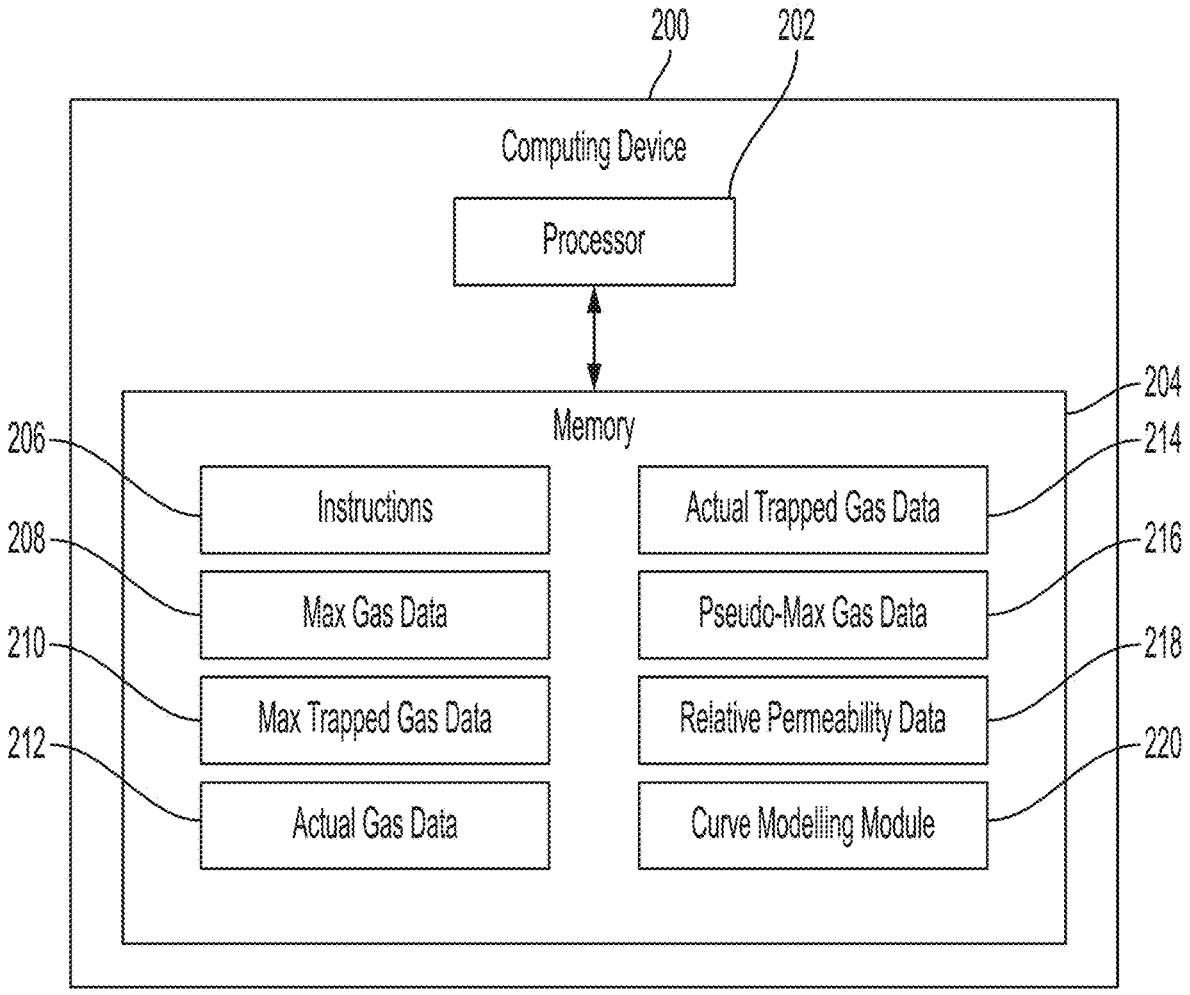
FIG. 2 is a block diagram of a computing device for modelling a fluid injection process according to some aspects of the present disclosure.

FIG. 2 is a block diagram of a computing device 200 for modelling a fluid injection process according to some aspects of the present disclosure. The computing device 200 includes a processor 202 communicatively coupled to a memory 204. The processor 202 can include one processing device or multiple processing devices. Non-limiting examples of the processor 202 include a Field-Programmable Gate Array (FPGA), an application-specific integrated circuit (ASIC), or a microprocessor. The processor 202 can execute instructions 206 stored in the memory 204 to perform computing operations. The instructions 206 may include processor-specific instructions generated by a compiler or an interpreter from code written in any suitable computer-programming language, such as C, C++, C #, Python, or Java.

The memory 204 can include one memory device or multiple memory devices. The memory 204 can be volatile or can be non-volatile, such that it can retain stored information when powered off. Some examples of the memory 204 can include electrically erasable and programmable read-only memory (EEPROM), flash memory, or any other type of non-volatile memory. At least some of the memory 204 includes a non-transitory computer-readable medium from which the processor 202 can read instructions 206. A computer-readable medium can include electronic, optical, magnetic, or other storage devices capable of providing the processor 202 with computer-readable instructions or other program code. Some examples of a computer-readable medium include magnetic disks, memory chips, ROM, random-access memory (RAM), an ASIC, a configured processor, optical storage, or any other medium from which a computer processor can read the instructions 206. The memory 204 also includes values for maximum gas saturation data 208, maximum trapped gas saturation data 210, actual gas saturation data 212, actual trapped gas saturation data 214, pseudo-maximum gas saturation data 216, and relative permeability data 218 of a subsurface formation.

Maximum trapped gas saturation data 210 and actual gas saturation data 212 may be derived from analysis of rock core plugs from a subsurface formation. In such experiments, the rock core plug may be fully saturated in hydrocarbons. The hydrocarbons may be dispersed by a laboratory treatment approximating a water-alternating-gas hydrocarbon recovery process. The hydrocarbons may be dispersed from the rock core plug until an irreducible saturation point is reached, at which point the fraction of porous space in the rock core plug occupied by fluid from the water-alternating-gas hydrocarbon recovery process is at maximum.

Maximum gas saturation data 208 may be a value useful for determining relative permeability data 218 of a subsurface formation. Maximum gas saturation data 208 may be determined from maximum trapped gas saturation data 210, actual gas saturation data 212, and a synthetic value for actual trapped gas saturation data 214. Actual trapped gas saturation data 214 may be a value useful for determining relative permeability data 218 of a subsurface formation.

Actual trapped gas saturation data 214 may be determined from maximum trapped gas saturation data 210, actual gas saturation data 212, and maximum gas saturation data 208. For example, (Eq. 1) may be used to determine actual trapped gas saturation data 214. In such an example, let maximum trapped gas saturation data 210 be Sgtr, let actual gas saturation data 212 be Sgu, let a synthetic value for actual trapped gas saturation data 214 be Sgtrap, and let maximum gas saturation data 208 be Sgmax. In such an example, the following equation may be used to determine maximum gas saturation data 208.

$$S_{grap} = \frac{S_{gmax}}{\left(s_{gmax}\left(\left(\frac{1}{S_{gtr}}\right) - \left(\frac{1}{S_{gu}}\right)\right) + 1\right)} \quad \text{(Eq. 1)}$$

Pseudo-maximum gas saturation data 216 may be a value useful for determining relative permeability data 218 of a subsurface formation. Additionally or alternatively, pseudo-maximum gas saturation data may be determined for subsequent values of the actual trapped gas saturation data 214 from hysteresis modeling accounting for fluid entrapment, in the formation, from the non-wetting phase when the fluid entrapment from the wetting-phase is increased. Pseudo-maximum gas saturation data 216 may be determined from actual trapped gas saturation data 214, maximum trapped gas saturation data 210, and actual gas saturation data 212.

Relative permeability data 218 can be a ratio of effective permeability of a particular fluid at a particular saturation against the absolute permeability of the same fluid at total saturation. Effective permeability of a subsurface formation to a fluid phase in pores of the subsurface formation can be a measure of the ability of that phase to flow in the presence of other fluid phases. Saturation may be the relative amount of water, carbon dioxide, and hydrocarbon in the pores of the subsurface formation. Relative permeability data 218 can be determined by a curve modeling module 220. The curve modeling module 220 may determine a non-linear relationship between values for gas saturation data and values for relative permeability data 218.

Figure 3:
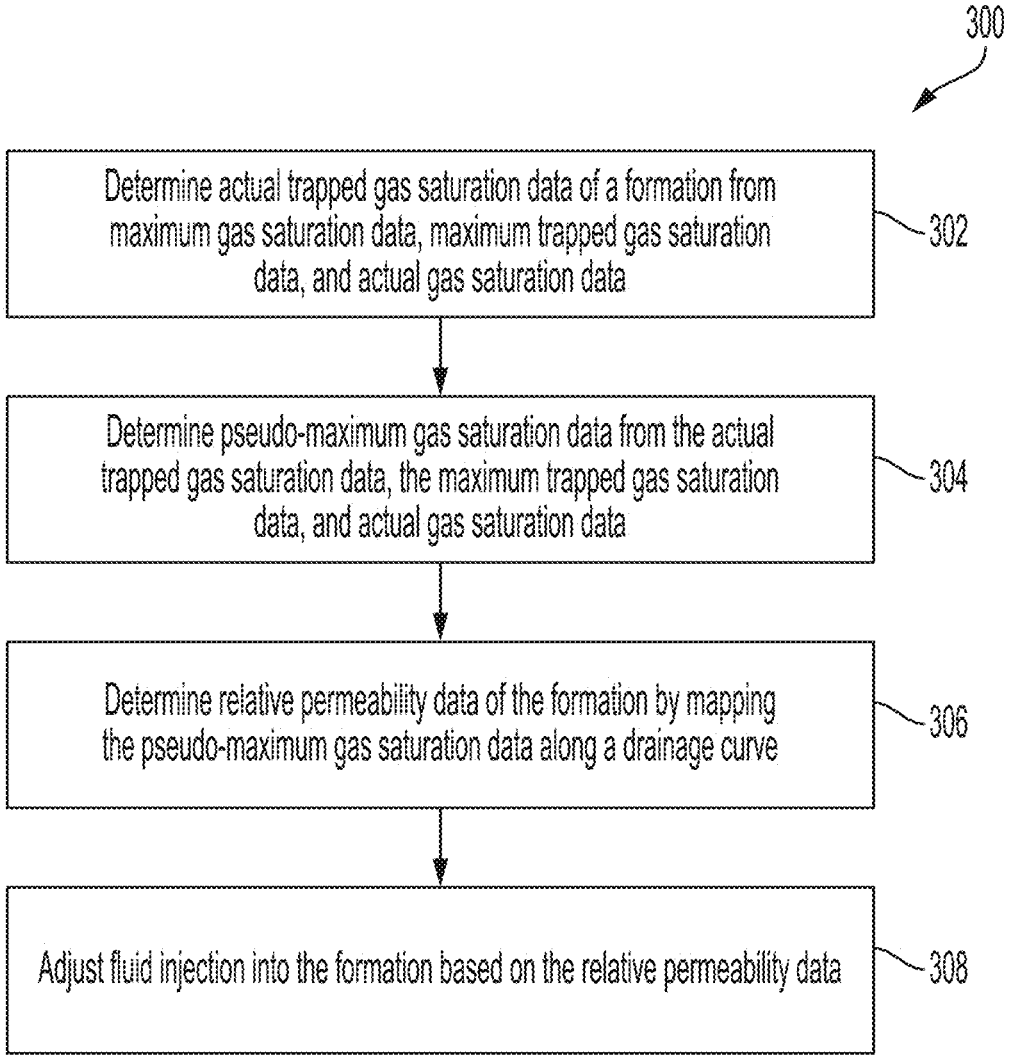
FIG. 3 is a flowchart for a process of adjusting a fluid injection into a formation based on a relative permeability of the formation according to some aspects of the present disclosure.

FIG. 3 is a flowchart 300 for a process of adjusting a fluid injection into a formation based on a relative permeability data 218 of the formation according to some aspects of the present disclosure. Some examples may include more steps, fewer steps, different steps, or a different combination of steps than is shown in FIG. 3. The steps of FIG. 3 are described below with reference to the components of FIG. 2 described above.

In block 302 the processor 202 may determine an actual trapped gas saturation data 214 of a formation from a maximum gas saturation data 208, a maximum trapped gas saturation data 210, and an actual gas saturation data 212. Maximum trapped gas saturation data 210 and actual gas saturation data 212 may be derived from analysis involving rock core plugs from a subsurface formation. Maximum gas saturation data 208 may be determined from maximum trapped gas saturation data 210, actual gas saturation data 212, and a synthetic value for an actual trapped gas saturation data 214.

In block 304, the processor 202 may determine a pseudo-maximum gas saturation data 216 from the synthetic value for the actual trapped gas saturation data 214, the maximum trapped gas saturation data 210, and the actual gas saturation data 212 using an inverse Land function. For example, let maximum trapped gas saturation data 210 be Sgtr, let actual gas saturation data 212 be Sgu, let the synthetic value for actual trapped gas saturation data 214 be Sgtrap, and let pseudo-maximum gas saturation data 216 be Sgmax_adj. In such an example, the following equation may be used to determine pseudo-maximum gas saturation data 216.

$$S_{gmax_adj} = \frac{1}{\left(\left(\frac{1}{S_{gtrap}}\right) - \left(\frac{1}{S_{gtr}}\right) + \left(\frac{1}{S_{gu}}\right)\right)} \quad \text{(Eq. 2)}$$

Before determining the pseudo-maximum gas saturation data 216, the processor 202 may determine the actual trapped gas saturation data 214 using a Land function, such as (Eq. 1) and the value for actual trapped gas saturation data 214 from block 302. The processor 202 may determine the pseudo-maximum gas saturation data 216.

In block 306 the processor 202 may determine a relative permeability data 218 of the formation by mapping the pseudo-maximum gas saturation data 216 along a drainage curve. A drainage curve may correspond values for relative permeability data 218 with values for gas saturation. A drainage curve may be selected from a plurality of drainage curves based on the value of actual gas saturation data 212 relative to actual trapped gas saturation data 214.

In block 308 the processor 202 may adjust fluid injection into a formation based on the relative permeability data 218. The relative permeability data 218 may indicate a quantity of total hydrocarbon reserves within the formation. The fluid injection may be adjusted to affect a hydrocarbon production rate of the formation. The particular amounts of carbon dioxide gas and water-based solution may also be adjusted, based on the relative permeability data 218, to affect the hydrocarbon production rate. For example, relative permeability can help determine the volume and duration of a wetting phase, in which a low-salinity water-based solution is injected into the wellbore and a non-wetting phase, in which a carbon-dioxide gas is injected into the wellbore. In such an example, an automatic adjustment of the wetting phase and the non-wetting phase may be controlled by the processor 202 based on the relative permeability data 218. The hydrocarbon production rate may be adjusted based on considerations such as market demand for hydrocarbons, a capacity for shipping hydrocarbons away from the well site, or a capacity for refining the hydrocarbons away from the well site. Additionally or alternatively, the relative permeability data 218 of a formation may inform a design of a surface facility for extracting hydrocarbons from the formation.

In some examples, the relative permeability data 218 may indicate a storage capacity of a formation for sequestering carbon dioxide extracted from the atmosphere. Carbon dioxide may be stored in subsurface formations such as depleted oil fields, depleted gas fields, saline formations, saline aquifers, saline-filled basalt formations, and coal seams. Carbon dioxide may be prevented from escaping to a surface by physical mechanisms, such as highly impermeable caprock.

Figure 4:
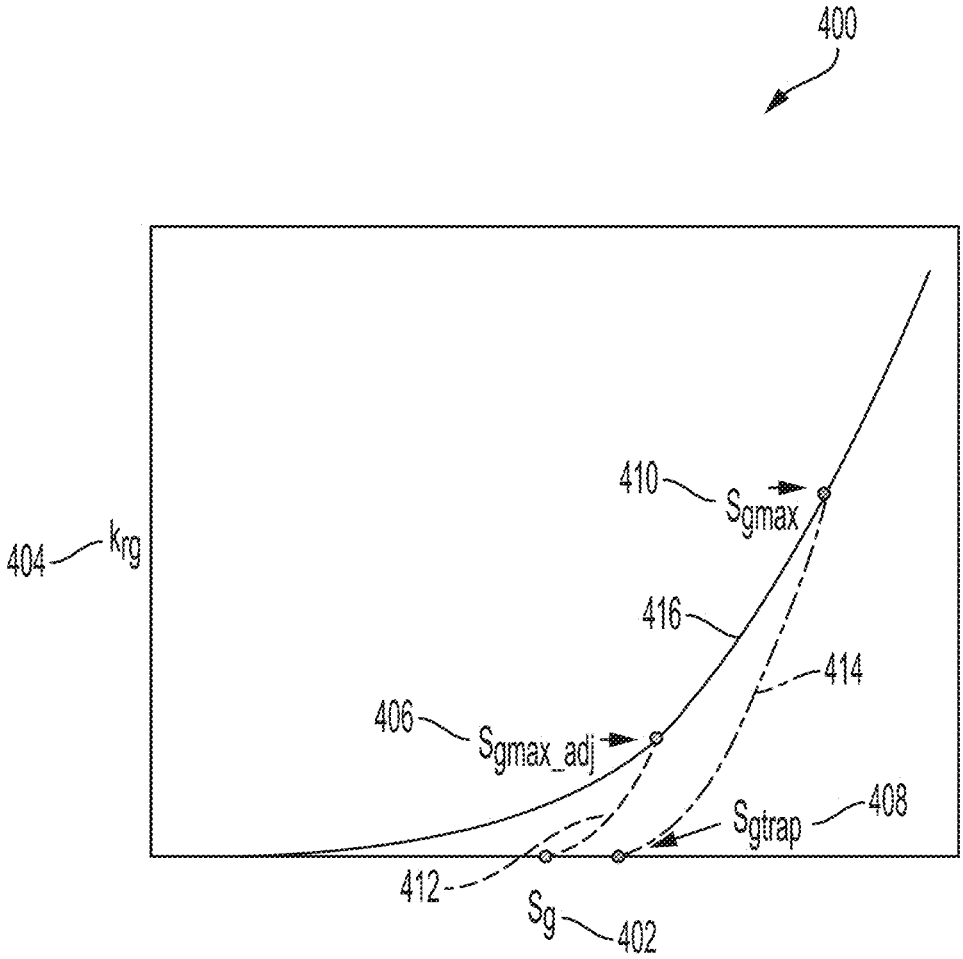
FIG. 4 is a graph of curves modelling gas saturation data against a relative permeability according to some aspects of the present disclosure.

FIG. 4 is a graph 400 of curves modelling gas saturation data against relative permeability data 404 according to some aspects of the present disclosure. The horizontal axis represents values of gas saturation data 402. The vertical axis represents values of relative permeability data 404. A pseudo-maximum gas saturation data 406 value lies along the primary drainage curve 416. An actual trapped gas saturation data 408 value lies at a point on the graph 400 where relative permeability data 404 is zero. A maximum gas saturation data 410 value also lies along the primary drainage curve 416.

A secondary curve 414 between the value for maximum gas saturation data 410 and the value for actual trapped gas saturation data 408 may represent a relationship between values of gas saturation data that may be expressed in (Eq. 1). The secondary curve 414 may allow for limited inferences using the primary drainage curve 416 when gas saturation data values are below the actual trapped gas saturation data 408 value.

A tertiary curve 412 between the value for pseudo-maximum gas saturation data 406 and a given gas saturation data value bay represent a relationship between values of gas saturation data that may be expressed in (Eq. 2). (Eq. 2) and the resulting tertiary curve 412 may be useful for determining relative permeability data 404 values from gas saturation data 402 values when the gas saturation data 402 values are less than the actual trapped gas saturation data 408 value.

Figure 5:
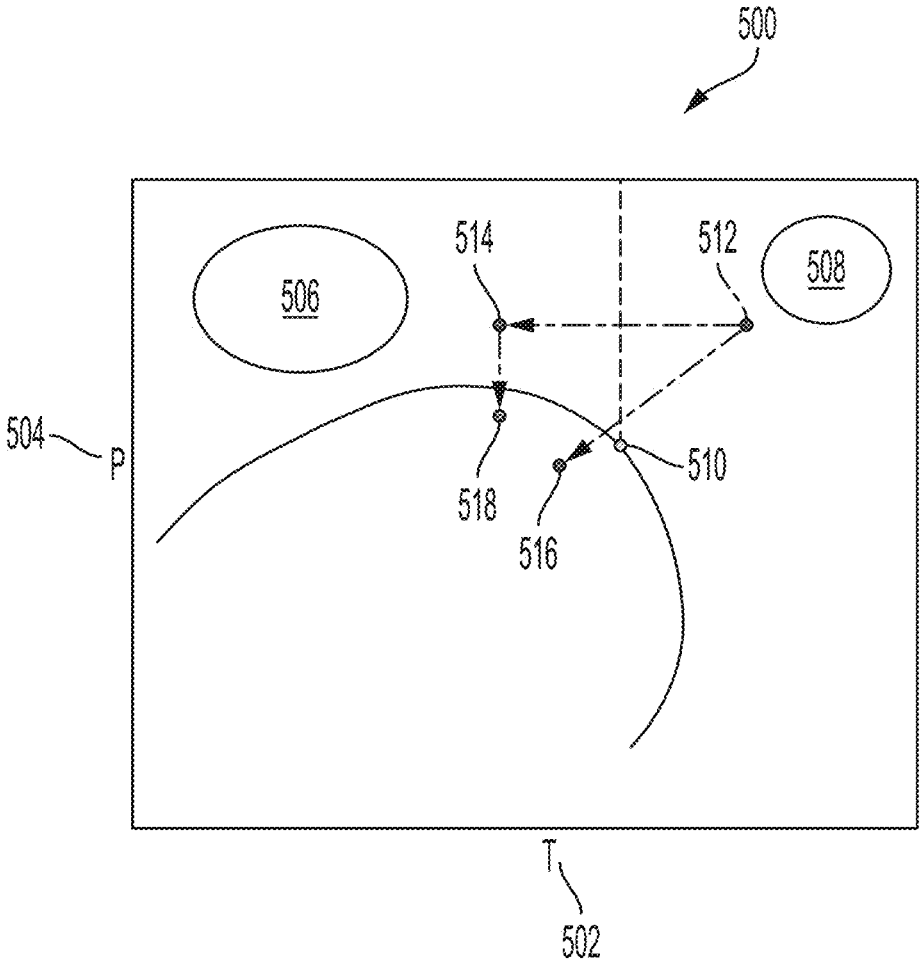
FIG. 5 is a phase diagram of a computer model for fluid injected into a subsurface formation according to some aspects of the present disclosure.

FIG. 5 is a phase diagram 500 of a computer model for fluid injected into a subsurface formation according to some aspects of the present disclosure. The phase diagram 500 may illustrate how a computer model which is not using the techniques described within this disclosure, particularly (Eq. 2), may simulate a phase change that may be physically impossible. The horizontal axis represents temperature 502 and the vertical axis represents pressure 504. The phase diagram 500 illustrates a gas phase 508 region, an oil phase 506 region, and a critical point 510 at which oil and gas phases may become indistinguishable.

At a first point 512, the model may begin simulating a water-alternating-gas production scenario with the fluid from the injection beginning in a gaseous phase. The model may determine the maximum gas saturation data when simulating the first point 512. From the first point 512, the model may simulate a scenario in which the fluid becomes supercritical oil at a second point 514 or a subcritical oil at a third point 516.

The model may proceed to the supercritical phase at the second point 514 or the subcritical phase at the third point 516 based on the amount and the composition of the fluids injected into the modeled formation, the amount and the composition of the fluids present in the modeled formation, the pressure within the modeled formation, and the temperature within the modeled formation. In an example where the fluid becomes a supercritical oil at the second point 514, carbon dioxide or water may be dissolved within hydrocarbons from the modeled formation, which may raise the viscosity of a fluid mixture of hydrocarbons, carbon dioxide, and water. The raised viscosity may allow for a more complete recovery of the hydrocarbons from the subsurface formation. In an example where the fluid becomes a subcritical oil at the third point 516, carbon dioxide and water may not dissolve into hydrocarbons of the modeled formation to sufficiently change the viscosity of the hydrocarbons or improve the recoverability of the hydrocarbons.

In some examples, modeling conditions may cause the simulated supercritical fluid at the second point 514 to fall to a subcritical phase illustrated as a fourth point 518. This progression, characterized by a fall in pressure 504, may not be physically possible. The progression from the second point 514 to the fourth point 518 may imply a simulated trapped gas saturation has disappeared without explanation. A model may be improved by utilizing (Eq. 2), which may prevent the model from progressing from the second point 514 to the fourth point 518.

In some aspects, methods, and systems for adjusting fluid injection into a wellbore based on relative permeability are provided according to one or more of the following examples:

As used below, any reference to a series of examples is to be understood as a reference to each of those examples disjunctively (e.g., "Examples 1-4" is to be understood as "Examples 1, 2, 3, or 4").

Example 1 is a computer implemented method comprising: determining actual trapped gas saturation data of a formation from maximum gas saturation data, maximum trapped gas saturation data, and actual gas saturation data; determining pseudo-maximum gas saturation data from the actual trapped gas saturation data, the maximum trapped gas saturation data, and the actual gas saturation data; determining relative permeability data of the formation by mapping the pseudo-maximum gas saturation data along a drainage curve; and adjusting fluid injection into the formation based on the relative permeability data.

Example 2 is the method of example 1, wherein the maximum trapped gas saturation data and the actual gas saturation data are derived from analysis of a core plug extracted from the formation.

Example 3 is the method of any of example(s) 1-2, wherein the pseudo-maximum gas saturation data is determined from the maximum trapped gas saturation data, the actual gas saturation data, and a synthetic value for the actual trapped gas saturation data in the following equation $$S_{gmax_adj} = \frac{1}{\left(\left(\frac{1}{S_{gtrap}}\right) - \left(\frac{1}{S_{gtr}}\right) + \left(\frac{1}{S_{gu}}\right)\right)} \quad \text{(Eq. 2)}$$

wherein the maximum trapped gas saturation is Sgtr, the actual gas saturation data is Sgu, the synthetic value for actual trapped gas saturation data is Sgtrap, and the pseudo-maximum gas saturation data is Sgmax_adj.

Example 4 is the method of any of example(s) 1-3, wherein the fluid injection is adjusted to alter a production rate of a water-alternating-gas hydrocarbon recovery process based on estimated total hydrocarbon reserves within the formation, derived from the relative permeability data.

Example 5 is the method of any of example(s) 1-4, wherein the fluid injection is adjusted to alter a storage rate of a geological sequestration process in which carbon dioxide is stored in the formation as a supercritical fluid, based on an estimated capacity of the formation derived from the relative permeability data as well as condensation effects derived from the actual trapped gas saturation data.

Example 6 is the method of any of example(s) 1-5, wherein the actual trapped gas saturation data and the pseudo-maximum gas saturation data are consistent with the Land function.

Example 7 is the method of any of the example(s) 1-6, wherein the pseudo-maximum gas saturation data is determined for subsequent values of the actual trapped gas saturation data from hysteresis modeling accounting for fluid entrapment from a non-wetting phase when the fluid entrapment from a wetting-phase is increased.

Example 8 is a system comprising: a processor; and a non-transitory computer-readable medium including program code that is executable by the processor for causing the processor to perform operations comprising: determine actual trapped gas saturation data of a formation from maximum gas saturation data, maximum trapped gas saturation data, and actual gas saturation data; determine pseudo-maximum gas saturation data from the actual trapped gas saturation data, the maximum trapped gas saturation data, and the actual gas saturation data; determine relative permeability data of the formation by mapping the pseudo-maximum gas saturation data along a drainage curve; and adjust fluid injection into the formation based on the relative permeability data.

Example 9 is the system of example 8, wherein the non-transitory computer-readable medium includes program code that is executable by the processor for causing the processor to perform operations comprising deriving the maximum trapped gas saturation data and the actual gas saturation data from analysis of a core plug extracted from the formation.

Example 10 is the system of any of example(s) 8-9, wherein the non-transitory computer-readable medium includes program code that is executable by the processor for causing the processor to perform operations comprising determining the pseudo-maximum gas saturation data from the maximum trapped gas saturation data, the actual gas saturation data, and a synthetic value for the actual trapped gas saturation data in the following equation $$S_{gmax_adj} = \frac{1}{\left(\left(\frac{1}{S_{gtrap}}\right) - \left(\frac{1}{S_{gtr}}\right) + \left(\frac{1}{S_{gu}}\right)\right)} \quad \text{(Eq. 2)}$$

wherein the maximum trapped gas saturation is Sgtr, the actual gas saturation data is Sgu, the synthetic value for actual trapped gas saturation data is Sgtrap, and the pseudo-maximum gas saturation data is Sgmax_adj.

Example 11 is the system of any of example(s) 8-10, wherein the non-transitory computer-readable medium includes program code that is executable by the processor for causing the processor to perform operations comprising adjusting the fluid injection to alter a production rate of a water-alternating-gas hydrocarbon recovery process based on estimated total hydrocarbon reserves within the formation, derived from the relative permeability data.

Example 12 is the system of any of the example(s) 8-11, wherein the non-transitory computer-readable medium includes program code that is executable by the processor for causing the processor to perform operations comprising adjusting the fluid injection to alter a storage rate of a geological sequestration process, in which carbon dioxide is stored in the formation as a supercritical fluid, based on an estimated capacity of the formation derived from the relative permeability data as well as condensation effects derived from the actual trapped gas saturation data.

Example 13 is the system of any of the example(s) 8-12, wherein the actual trapped gas saturation data and the pseudo-maximum gas saturation data are consistent with a Land function.

Example 14 is the system of any of the example(s) 8-13, wherein non-transitory computer-readable medium includes program code that is executable by the processor for causing the processor to perform operations comprising determining the pseudo-maximum gas saturation data for subsequent values of the actual trapped gas saturation data from hysteresis modeling accounting for fluid entrapment from a non-wetting phase when the fluid entrapment from a wetting-phase is increased.

Example 15 is a non-transitory computer-readable medium comprising program code that is executable by a processor for causing the processor to perform operations comprising: determine actual trapped gas saturation data of a formation from maximum gas saturation data, maximum trapped gas saturation data, and an actual gas saturation data; determine pseudo-maximum gas saturation data from the actual trapped gas saturation data, the maximum trapped gas saturation data, and the actual gas saturation data; determine relative permeability data of the formation by mapping the pseudo-maximum gas saturation data along a drainage curve; and adjust fluid injection into the formation based on the relative permeability data.

Example 16 is the non-transitory computer-readable medium of example 15, wherein the operations further comprise deriving the maximum trapped gas saturation data and the actual gas saturation data from analysis of a core plug extracted from the formation.

Example 17 is the non-transitory computer-readable medium of any of example(s) 15-16, wherein the operations further comprise determining the pseudo-maximum gas saturation data from the maximum trapped gas saturation data, the actual gas saturation data, and a synthetic value for the actual trapped gas saturation data in the following equation $$S_{gmax_adj} = \frac{1}{\left(\left(\frac{1}{S_{gtrap}}\right) - \left(\frac{1}{S_{gtr}}\right) + \left(\frac{1}{S_{gu}}\right)\right)} \quad \text{(Eq. 2)}$$

wherein the maximum trapped gas saturation is Sgtr, the actual gas saturation data is Sgu, the synthetic value for actual trapped gas saturation data is Sgtrap, and the pseudo-maximum gas saturation data is Sgmax_adj.

Example 18 is the non-transitory computer-readable medium of any of example(s) 15-17, wherein the operations further comprise adjusting the fluid injection to alter a production rate of a water-alternating-gas hydrocarbon recovery process based on estimated total hydrocarbon reserves within the formation, derived from the relative permeability data.

Example 19 is the non-transitory computer readable medium of any of example(s) 15-18, wherein the operations further comprise adjusting the fluid injection to alter a storage rate of a geological sequestration process in which carbon dioxide is stored in the formation as a supercritical fluid, based on an estimated capacity of the formation derived from the relative permeability data as well as condensation effects derived from the actual trapped gas saturation data.

Example 20 is the non-transitory computer readable medium of any of example(s) 15-19, wherein the actual trapped gas saturation data and the pseudo-maximum gas saturation data are consistent with a Land function.

The foregoing description of certain examples, including illustrated examples, has been presented only for the purpose of illustration and description and is not intended to be exhaustive or to limit the disclosure to the precise forms disclosed. Numerous modifications, adaptations, and uses thereof will be apparent to those skilled in the art without departing from the scope of the disclosure.

What is claimed is:

1. A computer implemented method comprising:

determining, by a processor of a computing device, actual trapped gas saturation data of a subsurface formation from maximum gas saturation data, maximum trapped gas saturation data, and actual gas saturation data;

determining, by the processor of the computing device, pseudo-maximum gas saturation data from the actual trapped gas saturation data, the maximum trapped gas saturation data, and the actual gas saturation data;

determining, by the processor of the computing device, relative permeability data of the subsurface formation by mapping the pseudo-maximum gas saturation data along a drainage curve; and affecting a hydrocarbon production rate of a hydrocarbon production well located in the subsurface formation by adjusting, by the processor of the computing device, fluid injection into an injection well located in the subsurface formation based on the relative permeability data.

2. The method of claim 1, wherein the maximum trapped gas saturation data and the actual gas saturation data are derived from analysis of a core plug extracted from the subsurface formation.

3. The method of claim 1, wherein the pseudo-maximum gas saturation data is determined from the maximum trapped gas saturation data, the actual gas saturation data, and a synthetic value for the actual trapped gas saturation data in the following equation $$S_{gmax_adj} = \frac{1}{\left(\left(\frac{1}{S_{gtrap}}\right) - \left(\frac{1}{S_{gtr}}\right) + \left(\frac{1}{S_{gu}}\right)\right)}$$

wherein the maximum trapped gas saturation is Sgtr, the actual gas saturation data is Sgu, the synthetic value for actual trapped gas saturation data is Sgtrap, and the pseudo-maximum gas saturation data is Sgmax_adj.

4. The method of claim 1, wherein the fluid injection is adjusted by the computing device to affect the hydrocarbon production rate of a water-alternating-gas hydrocarbon recovery process based on estimated total hydrocarbon reserves within the subsurface formation, derived from the relative permeability data.

5. The method of claim 1, wherein the fluid injection is adjusted by the computing device to alter a storage rate of a geological sequestration process in which carbon dioxide is stored in the subsurface formation as a supercritical fluid, based on an estimated capacity of the subsurface formation derived from the relative permeability data as well as condensation effects derived from the actual trapped gas saturation data.

6. The method of claim 1, wherein the actual trapped gas saturation data and the pseudo-maximum gas saturation data are consistent with a Land function.

7. The method of claim 6, wherein the pseudo-maximum gas saturation data is determined for subsequent values of the actual trapped gas saturation data from hysteresis modeling accounting for fluid entrapment from a non-wetting phase when the fluid entrapment from a wetting-phase is increased.

8. A system comprising:

a computing device including a processor and a non-transitory computer-readable medium including program code that is executable by the processor for causing the computing device to perform operations comprising:

determining actual trapped gas saturation data of a subsurface formation from maximum gas saturation data, maximum trapped gas saturation data, and actual gas saturation data, determining pseudo-maximum gas saturation data from the actual trapped gas saturation data, the maximum trapped gas saturation data, and the actual gas saturation data, and determining relative permeability data of the subsurface formation by mapping the pseudo-maximum gas saturation data along a drainage curve; and wherein the computing device is communicatively couplable to an injection distribution system associated with an injection well located in the subsurface formation to affect a hydrocarbon production rate of a hydrocarbon production well located in the subsurface formation by adjusting fluid injection from the injection distribution system into the injection well based on the relative permeability data.

9. The system of claim 8, wherein the operations further comprise deriving the maximum trapped gas saturation data and the actual gas saturation data from analysis of a core plug extracted from the subsurface formation.

10. The system of claim 8, wherein the non-transitory computer-readable medium includes program code that is executable by the processor for causing the processor to perform operations comprising determining the pseudo-maximum gas saturation data from the maximum trapped gas saturation data, the actual gas saturation data, and a synthetic value for the actual trapped gas saturation data in the following equation $$S_{gmax_adj} = \frac{1}{\left(\left(\frac{1}{S_{gtrap}}\right) - \left(\frac{1}{S_{gtr}}\right) + \left(\frac{1}{S_{gu}}\right)\right)}$$

wherein the maximum trapped gas saturation is Sgtr, the actual gas saturation data is Sgu, the synthetic value for actual trapped gas saturation data is Sgtrap, and the pseudo-maximum gas saturation data is Sgmax_adj.

11. The system of claim 8, wherein the fluid injection is part of a water-alternating-gas hydrocarbon recovery process and the operations further comprise adjusting the fluid injection based on estimated total hydrocarbon reserves within the subsurface formation, derived from the relative permeability data.

12. The system of claim 8, wherein the operations further comprise adjusting the fluid injection to alter a storage rate of a geological sequestration process, in which carbon dioxide is stored in the subsurface formation as a supercritical fluid, based on an estimated capacity of the substrate formation derived from the relative permeability data as well as condensation effects derived from the actual trapped gas saturation data.

13. The system of claim 8, wherein the actual trapped gas saturation data and the pseudo-maximum gas saturation data are consistent with a Land function.

14. The system of claim 13, wherein the operations further comprising determining the pseudo-maximum gas saturation data for subsequent values of the actual trapped gas saturation data from hysteresis modeling accounting for fluid entrapment from a non-wetting phase when the fluid entrapment from a wetting-phase is increased.

15. A non-transitory computer-readable medium comprising program code that is executable by a processor of a computing device for causing the processor to perform operations comprising:

determining actual trapped gas saturation data of a subsurface formation from maximum gas saturation data, maximum trapped gas saturation data, and an actual gas saturation data;

determining pseudo-maximum gas saturation data from the actual trapped gas saturation data, the maximum trapped gas saturation data, and the actual gas saturation data;

determining relative permeability data of the formation by mapping the pseudo-maximum gas saturation data along a drainage curve; and affecting a hydrocarbon production rate of a hydrocarbon production well located in the subsurface formation by adjusting fluid injection into an injection well located in the subsurface formation based on the relative permeability data.

16. The non-transitory computer-readable medium of claim 15, wherein the operations further comprise deriving the maximum trapped gas saturation data and the actual gas saturation data from analysis of a core plug extracted from the subsurface formation.

17. The non-transitory computer-readable medium of claim 15, wherein the operations further comprise determining the pseudo-maximum gas saturation data from the maximum trapped gas saturation data, the actual gas saturation data, and a synthetic value for the actual trapped gas saturation data in the following equation $$S_{gmax_adj} = \frac{1}{\left(\left(\frac{1}{S_{gtrap}}\right) - \left(\frac{1}{S_{gtr}}\right) + \left(\frac{1}{S_{gu}}\right)\right)}$$

wherein the maximum trapped gas saturation is Sgtr, the actual gas saturation data is Sgu, the synthetic value for actual trapped gas saturation data is Sgtrap, and the pseudo-maximum gas saturation data is Sgmax_adj.

18. The non-transitory computer-readable medium of claim 15, wherein the fluid injection is part of a water-alternating-gas hydrocarbon recovery process and the operations further comprise adjusting the fluid injection based on estimated total hydrocarbon reserves within the subsurface formation, derived from the relative permeability data.

19. The non-transitory computer-readable medium of claim 15, wherein the operations further comprise adjusting the fluid injection to alter a storage rate of a geological sequestration process in which carbon dioxide is stored in the subsurface formation as a supercritical fluid, based on an estimated capacity of the subsurface formation derived from the relative permeability data as well as condensation effects derived from the actual trapped gas saturation data.

20. The non-transitory computer-readable medium of claim 15, wherein the actual trapped gas saturation data and the pseudo-maximum gas saturation data are consistent with a Land function.

* * * * *